US005095578A

United States Patent [19]

Wade

[11] Patent Number: 5,095,578

[45] Date of Patent: Mar. 17, 1992

[54] VACUUM SYSTEM FOR CLEANING APPARATUS

[75] Inventor: Calvin N. Wade, Hico, Tex.

[73] Assignee: Steamatic, Inc., Grand Prairie, Tex.

[21] Appl. No.: 654,247

[22] Filed: Feb. 12, 1991

[51] Int. Cl.[5] ..... A47L 11/34

[52] U.S. Cl. ..... 15/321; 15/339; 15/412; 15/422.2

[58] Field of Search ..... 15/321, 339, 412, 422.2

[56] References Cited

U.S. PATENT DOCUMENTS

| | | | |
|---|---|---|---|
| 4,159,554 | 7/1979 | Knight et al. | 15/321 |
| 4,284,127 | 8/1981 | Collier et al. | 15/321 X |
| 4,862,551 | 9/1989 | Martinez et al. | 15/321 |
| 4,949,424 | 8/1990 | Shero | 15/339 X |
| 4,991,254 | 2/1991 | Roden et al. | 15/321 |

*Primary Examiner*—Chris K. Moore
*Attorney, Agent, or Firm*—Arthur F. Zobal

[57] ABSTRACT

The cleaning apparatus has a liquid spray device and a vacuum head attached to a movable support member. A container is provided for holding a supply of liquid. A liquid pump has its inlet coupled to the container and its outlet coupled to a heat exchanger. The outlet of the heat exchanger is coupled to a high pressure liquid conduit which is coupled to the spray device by way of a flow control valve. A return conduit is coupled from the flow control valve to the container. Two electrically actuated vacuum blowers are provided with the first blower having its inlet coupled to a vacuum tank and its outlet coupled to the inlet of the second blower. The vacuum head is coupled to the vacuum tank by way of a conduit. A switch is provided for completing a circuit to the first blower and by way of a time delay circuit to the second blower whereby when the switch is closed, the first blower begins to operate and after a time delay, the second blower begins to operate.

2 Claims, 7 Drawing Sheets

VACUUM SYSTEM FOR CLEANING APPARATUS

FIELD OF THE INVENTION

The invention relates to a cleaning apparatus for spraying hot liquid onto a surface to be cleaned and for removing the liquid and waste material with a vacuum.

DESCRIPTION OF THE PRIOR ART

U.S. Pat. No. 3,812,552 discloses a cleaning apparatus having a container for holding a supply of liquid and a liquid pump for pumping the liquid to a spray means by way of a heat exchanger and a high pressure line. The hot liquid is sprayed onto a surface to be cleaned and a vacuum head is employed to remove the liquid and waste material from the surface. Also employed is a three way valve and a return bypass hose for allowing the hot liquid to be circulated back to the pump while spraying operations are not being carried out to insure a constant source of hot liquid at the liquid spray means.

The apparatus of U.S. Pat. No. 3,812,552 employed has had two electrically operated vacuum blowers. In operation, both blowers have been started simultaneously which has caused problems in that a very high surge in current has resulted which can damage the electrical system.

SUMMARY OF THE INVENTION

It is an object of the invention to provide in a cleaning apparatus having first and second electrically operated vacuum blowers, a system for delaying the application of current to the second blower after the first blower is started.

DESCRIPTION OF THE PREFERRED EMBODIMENTS

Figure 1:
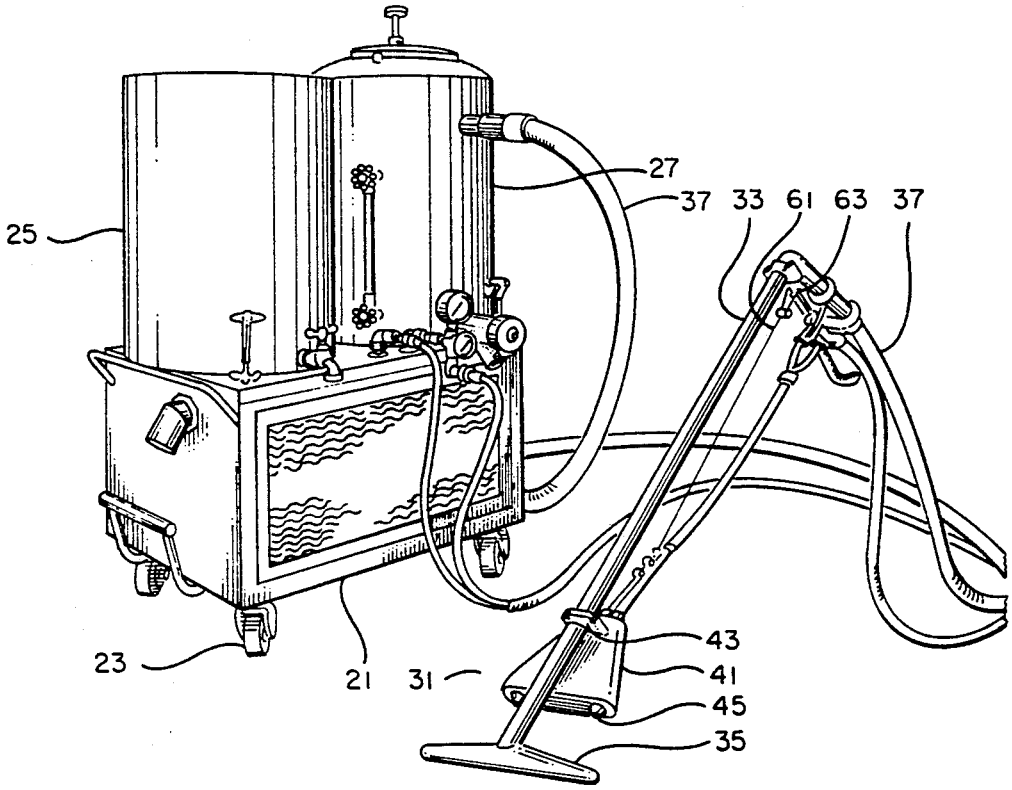
FIG. 1 illustrates an operator movable support means for supporting a liquid spray means and a suction head which are coupled by way of flexible hoses to apparatus supported on a portable cart.
Figure 3:
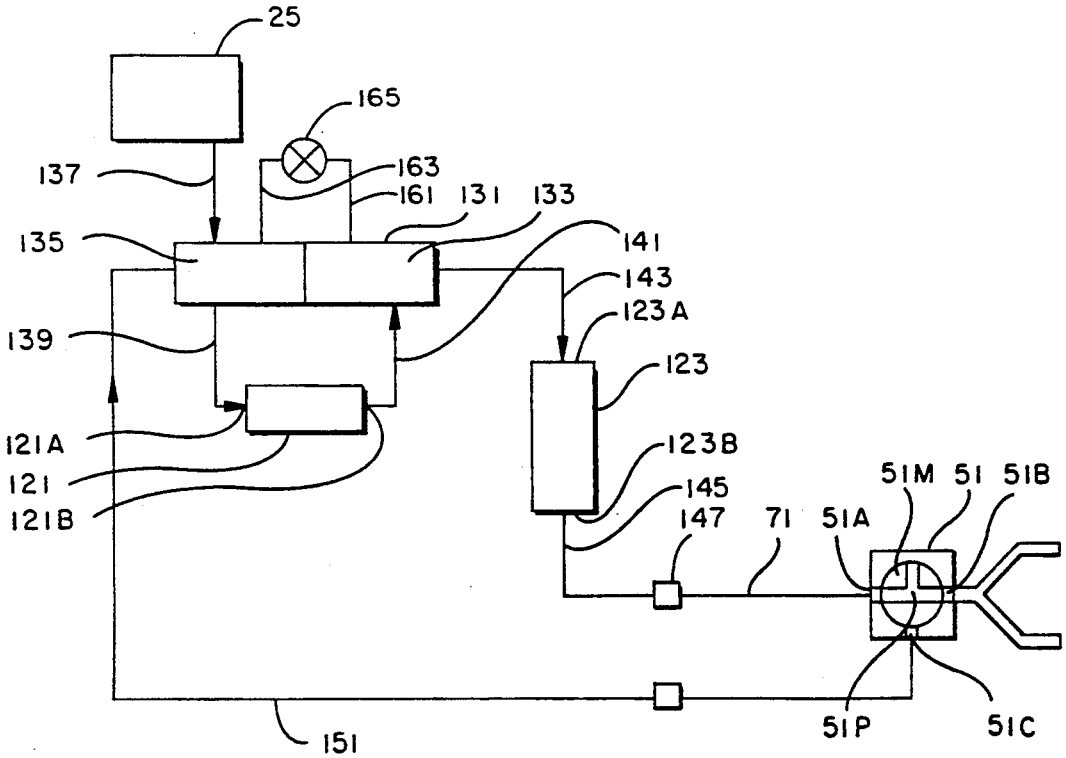
FIG. 3 is a schematic of the liquid pump system of the cleaning apparatus.

Referring now to the drawings, there is disclosed a portable cart 21 on wheels 23 for supporting a liquid supply container or tank 25, a vacuum tank 27 and other hardware of the apparatus of the invention. Also provided is a support means 31 compressing a metal tubular member 33 having a hollow vacuum head 35 with a lower opening, coupled to its lower end and a flexible hose 37 coupled to its upper end and to the upper end of the vacuum tank 27. A liquid spray support 41 is connected to the lower end of the tubular member 33 by a clamp 43. The support 41 carries liquid spray nozzles 45 which are coupled to a three way valve 51 which is carried by the support 41. The three way valve 51 has three ports 51A, 51B, and 51C with an interior control member 51M depicted with a T shaped passage 51P and which can be moved to a spray position to connect port 51A with port 51B, or to a return position to connect port 51A with port 51C. A wire 61 is connected to the member 51M and to a trigger means 63 supported at the upper end of tubular member 33. The valve member 51M is biased by a spring (not shown) to the return position. Reference also is made to U.S. Pat. No. 3,812,552 for this type of valve arrangement and which patent is incorporated herein by reference. The nozzles 45 are coupled to port 51B; a flexible high pressure liquid hose 71 is coupled to port 51A; and a flexible liquid return hose 73 is coupled to the port 51C.

The nozzles 45 are supported on the tubular member 33 such that when the lower opening of the vacuum head 35 is against the floor or other surface to be cleaned, liquid spray from the nozzles 45 is directed against the surface behind the vacuum head 35.

In use, with the liquid pump system and the vacuum system operating, the operator can locate the vacuum head 35 against the surface to be cleaned, move the trigger 63 to move the valve member 51M to its spray position to spray hot liquid against the surface to be cleaned. At the same time, with the vacuum system operating the operator can move the support 31 backward to pick up the liquid and waste from the floor by way of the vacuum head 35, tubular member 33, hose 37, and vacuum tank 27. By releasing the trigger 63, the valve member 51M will return to its return position to circulate hot liquid from hose 71 to hose 73 to maintain a constant supply of hot liquid at the control valve 51.

The vacuum tank 27 has a central pipe 81 with an upper open end 83 which extends to upper portion of the tank 27. The upper end of the pipe 81 normally is open. The lower end of the pipe 81 is coupled to a conduit 85 which is coupled to one chamber 101 of a two chamber vacuum manifold 103. The other chamber of the manifold 103 is shown at 105. Chambers 101 and 105 are separate from each other. Two electrically operated vacuum blowers 107 and 109 are provided. The inlet of vacuum blower 107 is coupled to chamber 101 and its outlet 111 is coupled to chamber 105. The inlet or vacuum blower 109 is coupled to chamber 105 and its outlet 113 exhausts to the atmosphere.

An electrically operated liquid pump 121 is provided to pump cleaning liquid from the tank 25 to the hose 71 by way of an electrically operated heat exchanger 123. A liquid manifold 131 is provided and which has two separate chambers 133 and 135. The bottom of the tank 25 is coupled to chamber 135 by way of a conduit 137. The inlet 121A of the pump 121 is coupled to chamber 135 by way of conduit 139 and the outlet 121B of the pump 121 is coupled to chamber 133 by way of conduit 141. The inlet 123A of the heat exchanger 123 is coupled to the chamber 133 by Way of conduit 143. The outlet 123B of the heat exchanger 123 is coupled to hose conduit 145 which is coupled to hose 71 by a quick disconnect 147. Hose 73 is coupled to hose conduit 151 by a quick disconnect 153 and conduit 151 is coupled to the chamber 135. Two conduits 161 and 163 are coupled to chambers 133 and 135 respectively and a valve 165 is coupled between conduits 161 and 163. Valve 165 has a knob control means 165A for adjusting the opening of the valve 165 between conduits 161 and 163. Valve 165 is a conventional needle valve having an adjustment knob 165A.

With the pump 121 operating and power applied to the heat exchanger, cleaning liquid from the tank 25 is drawn into chamber 135, through the pump 121, and pumped under pressure into chamber 133, through the heat exchanger 123 and to the hose 71. When the member 51M of the valve 51 returns to chamber 135 by way of hose 73 and conduit 151 for recirculation. When the valve member 51M is in the spray position, hot liquid from hose 71 is sprayed through the nozzles 45.

If the outlet of the pump 121 starts pulsating too much, the knob 165A of the valve 165 can be adjusted to increase or decrease the opening through the valve 165 to minimize the pulsations or pressure variations of the liquid from the outlet of the pump 121. The opening through the valve 165 allows enough fluid communication between the high pressure chamber 133 and the low pressure chamber 135 to dampen the highs and lows of any pressure pulsations in the system.

Figure 4:
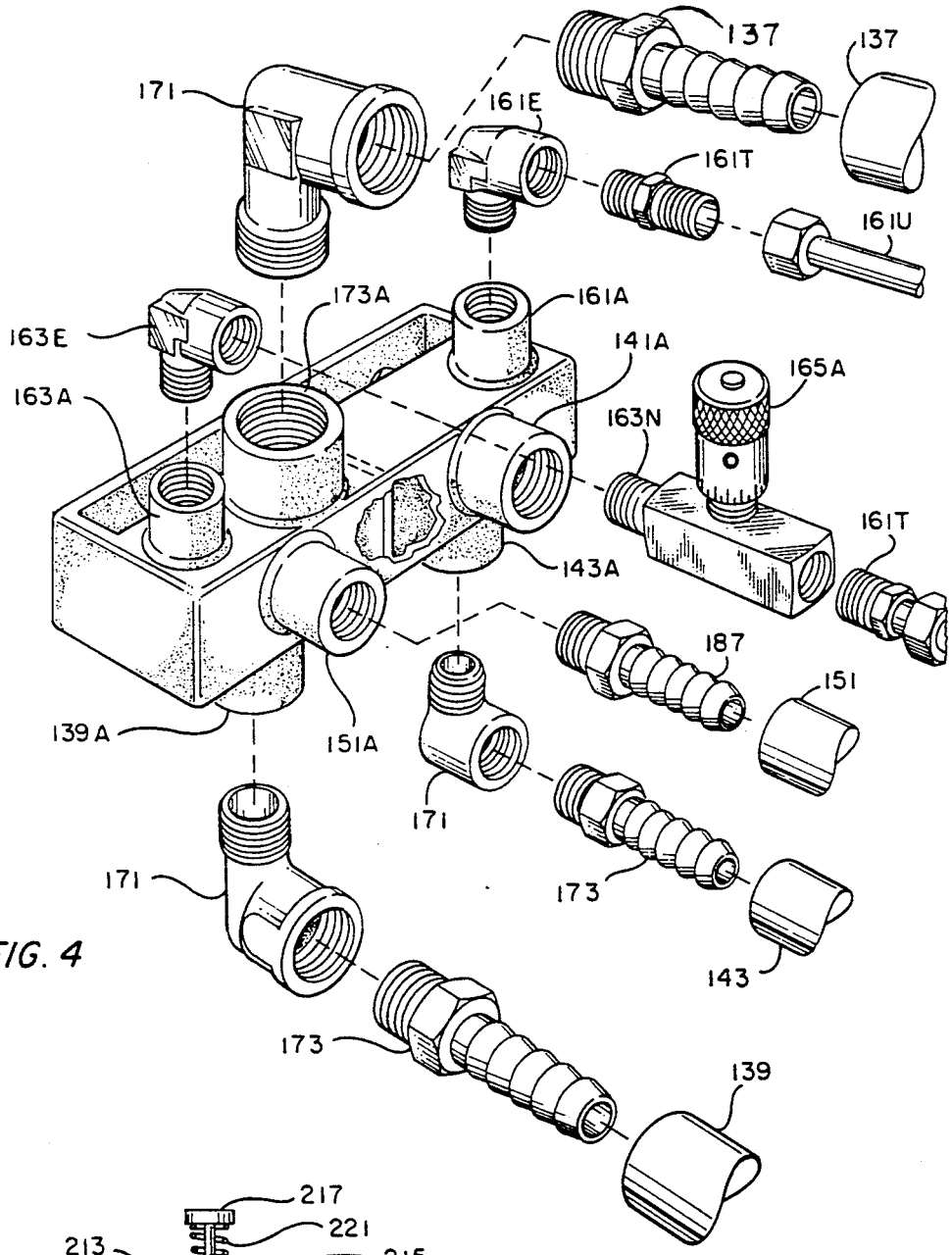
FIG. 4 is an exploded view of the liquid manifold of the apparatus of FIGS. 2 and 3.
Figure 5:
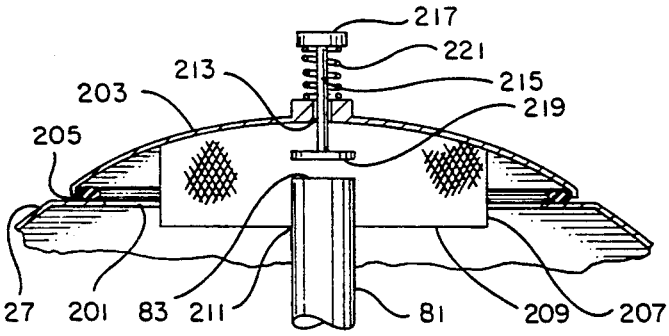
FIG. 5 illustrates the dump lid of the vacuum container of the apparatus of FIGS. 1 and 2.

Referring to FIG. 4, the hardware for connecting the conduits 137, 139, 141, 143, 161 and 163 is shown in detail. Members 137A, 139A, 151A and 163A are internally threaded couplinq members welded to the manifold 131 in communication with chamber 135. Members 141A, 143A, and 161A are internally threaded coupling members welded to the manifold 131 in communication with chamber 133. Elbows 171, hose barbs 173 and clamps (not shown) are used for coupling hose conduit 137 to coupling 137A, hose Conduit 139 to coupling 139A and hose conduit 143 to coupling 143A. An elbow 163E and a nipple 163N couples one side of the value 165 to the coupling 163A and an elbow 161E, tubular fittings 161T, and a U-shaped tubular fitting 161U are used to couple the other side of valve 165 to coupling 161A. A hose barb 187 and a clamp (not shown) are used to couple conduit hose conduit 151 to coupling 151A. Although not shown, a hose barb similar to that of 187 and a clamp are used to couple conduit hose 141 to coupling 141A.

Thus as can be understood, the various hoses and conduits can be readily coupled to the manifold 131 for proper routing and the water pump 121 can be readily replaced if necessary. In addition, air at the top of the chambers 133 and 135 bubbles back through the liquid supply line 137 to the container 25 and hence allows air to be continually bled from the system. In one embodiment, the liquid pump 121 is three diaphragm pump purchased from Shur Flow of Santa Anna, California. It is a Model No. 800-723-238 and has a flow rate of 1.8 gal/min. Each of the chambers 133 and 135 have dimensions of about 1.75 by 0.75 by 0.75 inches. The valve 165 is a needle valve purchased from Parker of Elyria, Ohio, Model No. N200B.

There now will be described additional features and components of the cleaning apparatus.

The water tank 25 and the vacuum tank 27 each have lower drain outlets 25A and 27A which can be opened or closed by valves 25V and 27V respectively. The top of the tank 27 has a circular opening 201 which can be closed by a removable lid 203 and a seal 205. The lid 203 has a cylindrical screen 207 with a bottom 209 that has a circular opening 211 formed therethrough for receiving the upper end of the pipe 81 when the lid 203 is located in its closed position. The center of the lid 203 has an opening 213 formed therethrough for freely receiving the shaft 215 of a plunger having an upper knob 217 and a lower pipe cover 219. A coil spring 221 located around the shaft 215 above the lid urges the shaft 215 and pipe cover 219 upward to normally maintain the upper end of the pipe 81 open. By manually pushing down on the knob 217 the cover 219 will engage and close the upper end of the pipe 81 to allow the tank 27 to be drained by way of outlet 27A without shutting down the vacuum blowers 107 and 109 thereby eliminating start-up surge current.

Figure 2:
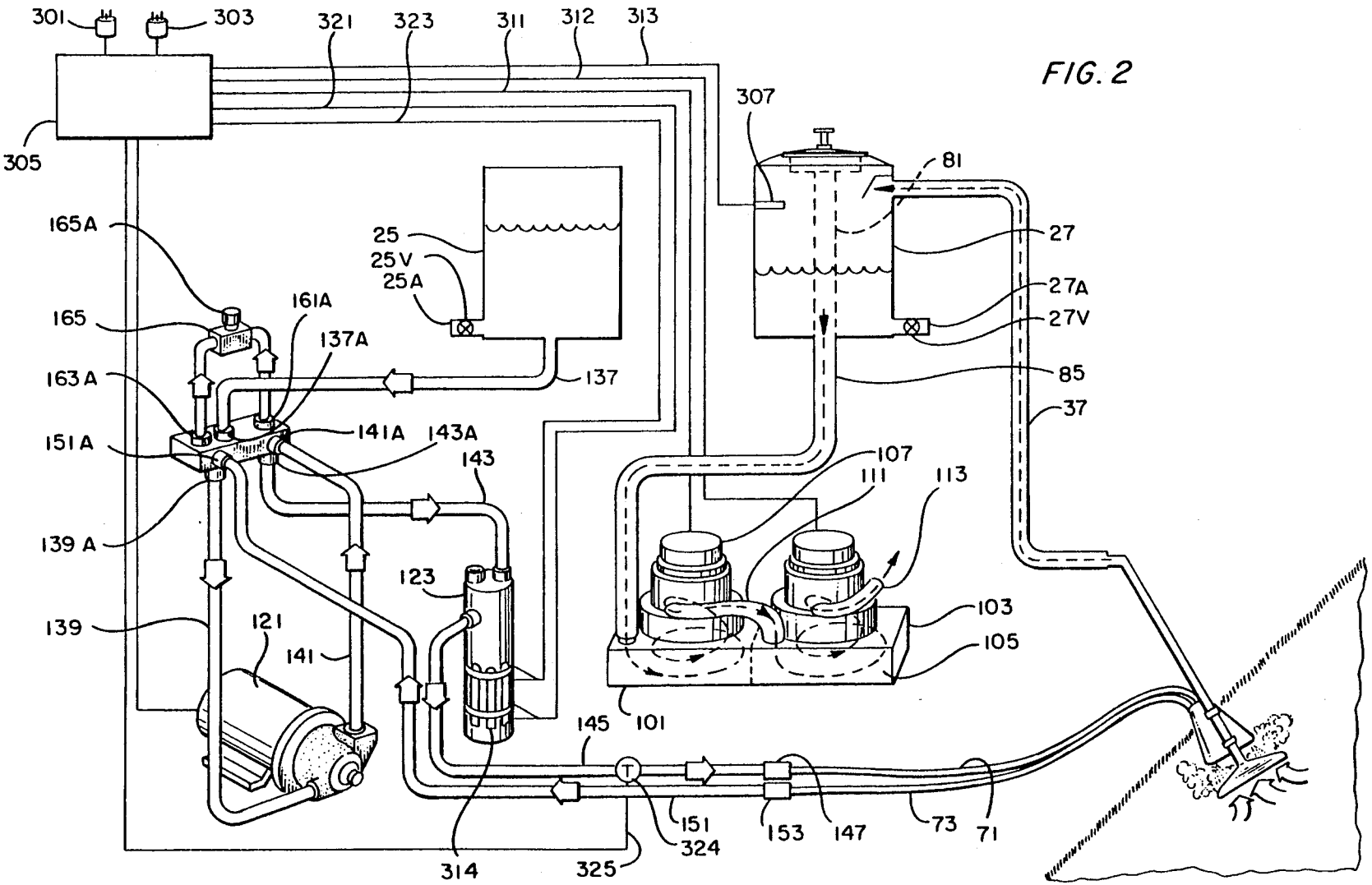
FIG. 2 is a schematic of the cleaning apparatus of FIG. 1 incorporating the invention.

Referring to FIG. 2, the electrical system has two 120 volt, A.C., 20 amp circuits with two separate electrical plug outlets 301 and 303 extending from an electrical control box 305 which houses the electrical control system. One circuit operates the vacuum blowers 107 and 109 and an overflow safety sensor 307 by way of leads depicted at 311, 312, and 313. The other circuit operates the electrical heaters 314 of the heat exchanger 123 by way of leads depicted at 321 and 323 and a thermostat 324 by way of a lead depicted at 325.

The heat exchanger 123 has four 500 watt heating elements 314. When the heater system is switched on, electrical power is applied to pump 121 and after a time delay, power is applied to all four heating elements 314. The switch of a thermostat 324 is normally closed and opens upon the rise of temperature to control operation of the heating elements 314. A switch is provided to allow only two of the heating elements 314 to operate if desired.

For cleaning purposes, the tank 25 will hold water mixed with a suitable cleaning solution for supply to the nozzles 45.

When the vacuum system is switched on (assuming that the tank 27 is empty and the float switch 307 in the tank 27 is open) electrical power is applied to one of the vacuum blowers and after a time delay, electrical power is applied to the other vacuum blower to prevent a high surge of current from affecting the electrical system. A switch is provided to allow only one vacuum blower to operate if desired. If the tank 27 is full on start up or becomes full, the vacuum blowers won't operate.

Figure 6:
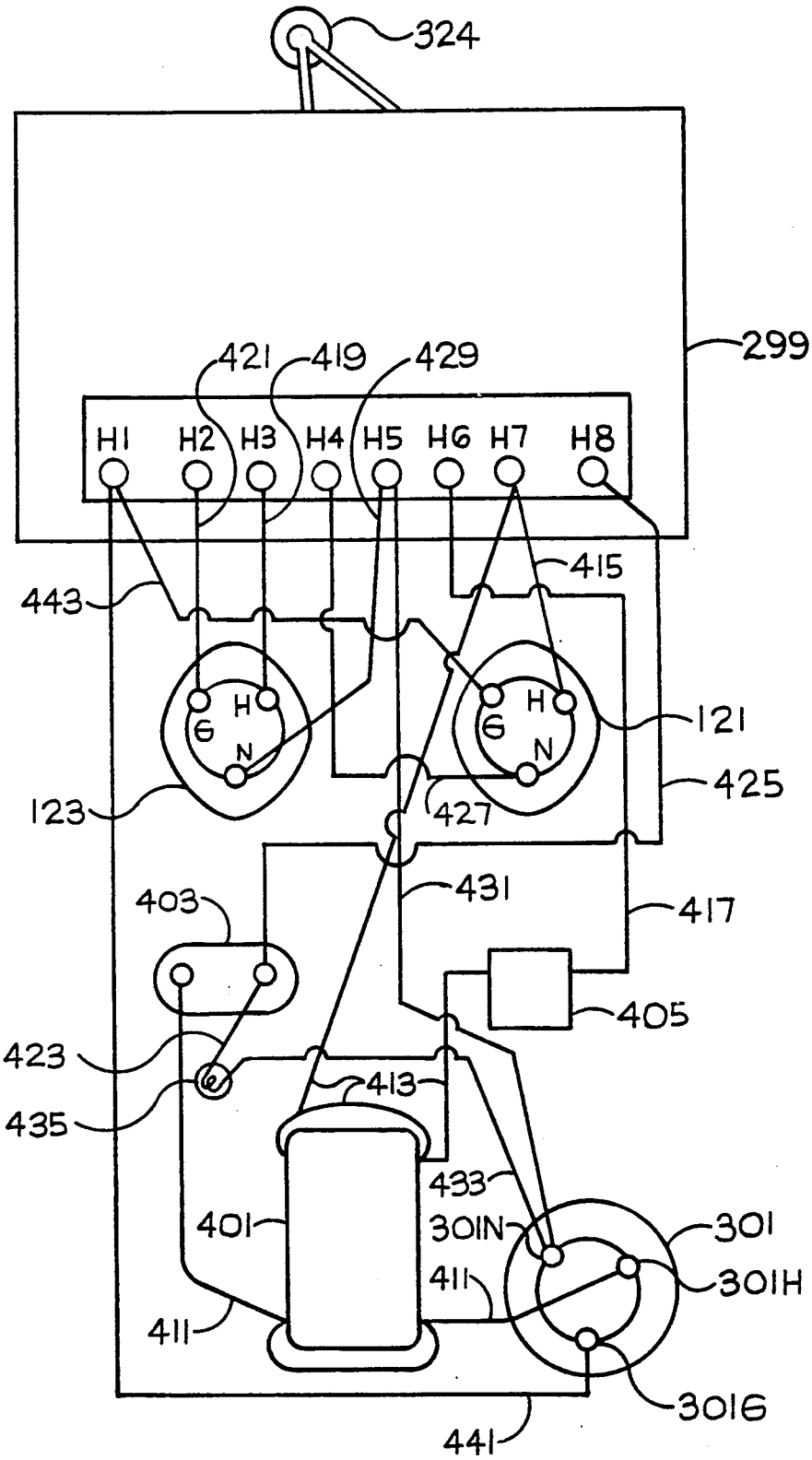
FIG. 6 is a schematic of the exterior electrical system of the pump and heat exchanger of the system of FIG. 2.
Figure 7:
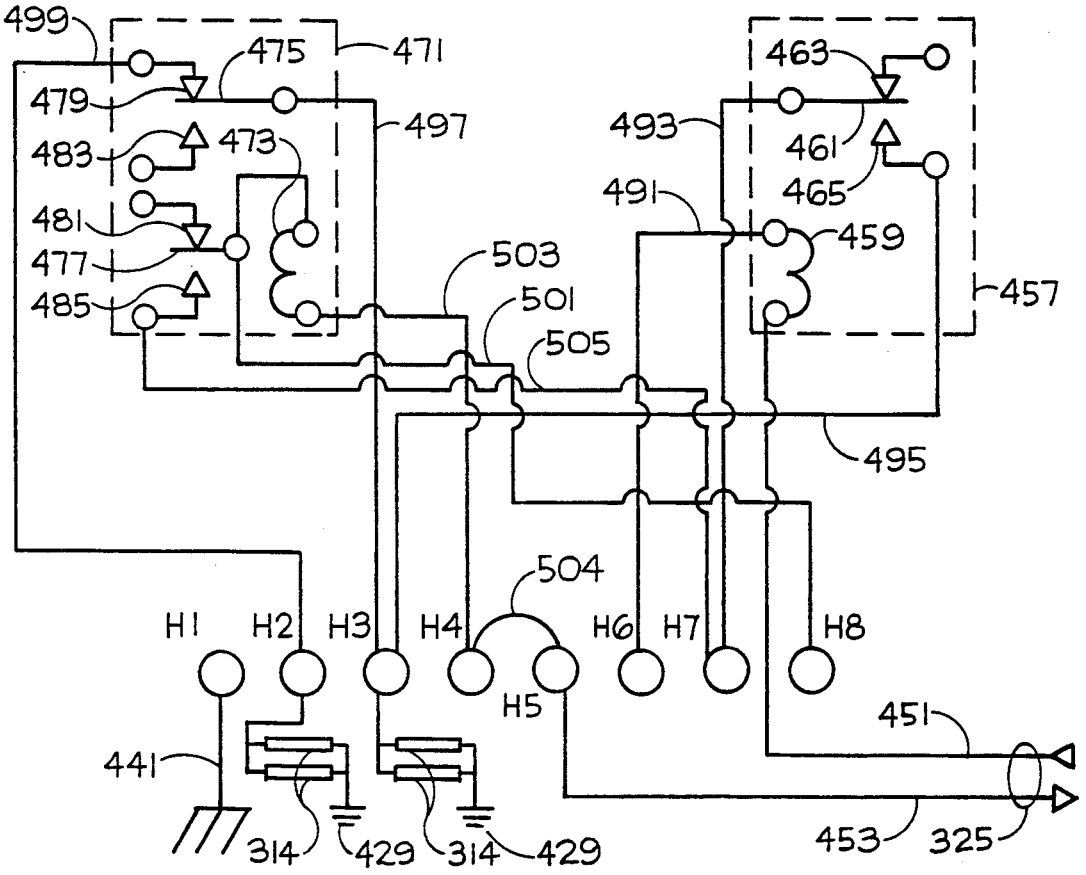
FIG. 7 is a schematic of the heater module of FIG. 6.

Referring now to FIGS. 6 and 7, the electrical pump and heating system will be described in detail. Terminals H1–H8 are connected to the external components as shown in FIG. 6 and to the internal components of the heater module 299 as shown in FIG. 7.

In FIG. 6, the electrical plug 301 has a hot prong terminal 301H, a neutral prong terminal 301N, and a safety ground prong terminal 301G. Member 401 is a manually controllable double pole switch; member 403 is a normally open push button switch; and member 405 is an electrical time delay circuit which has a time delay of about 5 seconds. The pump 121 is illustrated as well as the heat exchanger 123. In FIG. 6, leads 411, 413, 415, 417, 419, 421, 423, and 425 are hot leads which are connected as shown. Leads 427, 429, 431, and 433 are neutral return leads which are connected as shown. Member 435 is an amber light which indicates half heat. Member 324 is a thermostat which is normally closed and which opens on a rise in temperature. Lead 419 is connected from terminal H3 to two of the heating elements 314 which are connected in parallel and then to the neutral leads 429 and 431. Lead 421 is a hot lead connected from terminal H2 to the other two heating elements 314 which are connected in parallel and to the neutral return leads 429 and 431. Leads 441, and 443 are safety earth ground leads.

In FIG. 7, leads 451 and 453 are connected to the thermostat 324 which controls a thermostat relay 457 comprising a coil 459 and a switch 461 adapted to contact terminals 463 and 465. When coil 459 is de-energized switch 461 normally contacts terminal 463. When coil 459 is energized, switch 461 contacts normally open terminal 465. A half-heat relay 471 is provided which includes a coil 473 and two switches 475 and 477. When the coil 473 is de-energized, switch 475 normally contacts terminal 479 and switch 477 normally contacts terminal 481. When the coil 473 is energized, switch 475 contacts normally open terminal 483 and switch 477 contacts normally open terminal 485.

The system of FIGS. 6 and 7 operates in the following manner. When the switch 401 is closed, electrical current is applied to the switch 401 by way of lead 411 and from the switch 401 to terminal H7 by way of lead 413. From terminal H7, the electrical current is applied to the hot terminal of the water pump 121 by way of lead 415 and the water pump immediately starts operating. In addition, electrical current is applied by way of lead 413 to the relay time delay 405 which delays for about 5 seconds and then applies electrical current by way of lead 417 to terminal H6. From terminal H6, the current is applied to the coil 459 by way of lead 491 which then flows to the normally closed thermostat 324 by way of lead 451. This causes switch 461 to contact terminal 465 allowing current to flow from terminal H7 by way of lead 493, switch 461, terminal 465, and lead 495, to terminal H3 which is directly connected to two of the heating elements 314. In addition, from terminal H3, current is applied by wa of lead 497 to switch 475 and by way of lead 499 to terminal H2 which is connected directly to the other two heating elements 314. Thus after the pump 121 begins operating, all four heating elements 314, after a time delay of about 5 seconds begin producing heat. If the temperature rises too high, the thermostat 324 opens causing current to be disconnected from terminals H3 and H2.

If it is desired to operate only one set of the heating elements 314, then the push button switch 403 is momentarily closed which applies current to lead 425 and hence to terminal H8. The current then flows by way of lead 501 through the coil 473 which causes switches 475 and 477 to engage the terminals 483 and 485 respectfully. The flow of current from coil 473 is by way of lead 503 to terminals H4 and H5 and then to lead 453 to the neutral side. Relay 471 is a self latching relay and when coil 473 is energized, current flows from terminal H7 by way of lead of 505 to terminal 485, switch 477, through coil 473 and to terminal H4 and H5 by way of lead 503 maintaining the coil 473 energized. This terminates the flow of current to terminal H2 and hence shuts down the heating elements connected to terminal H2. Terminals H4 and H5 are connected together by lead 504.

When the main power switch 401 is moved to an "off" position, the circuit resets itself.

The time delay 405 is a commercially available device in one embodiment having a Model No. 2A560, manufactured by Dayton of Chicago, Ill. It is a solid state device having a time delay adjustable from 0.25 of a second to 5 seconds.

Figure 8:
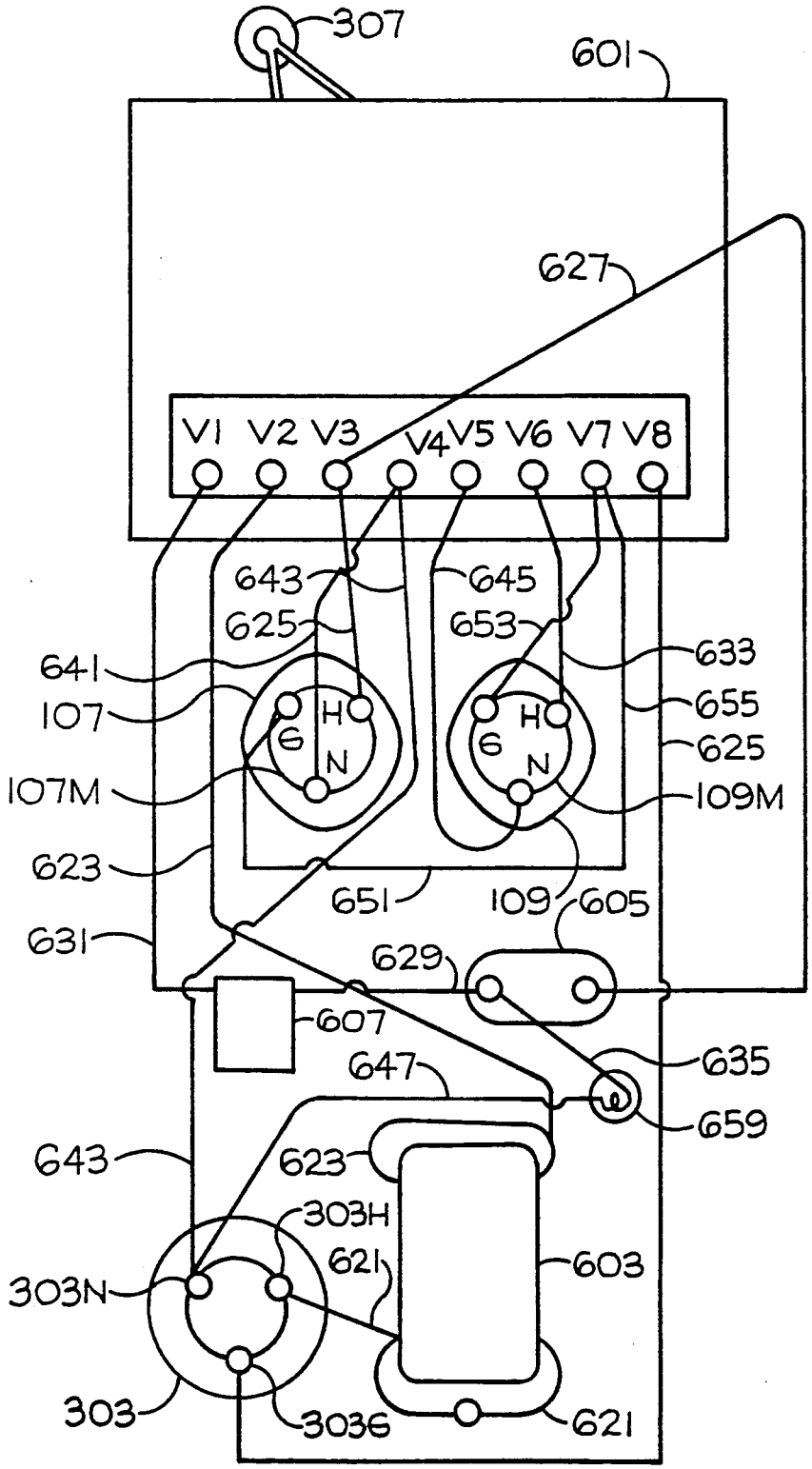
FIG. 8 is a schematic of the exterior electrical system of vacuum blowers of FIG. 2.
Figure 9:
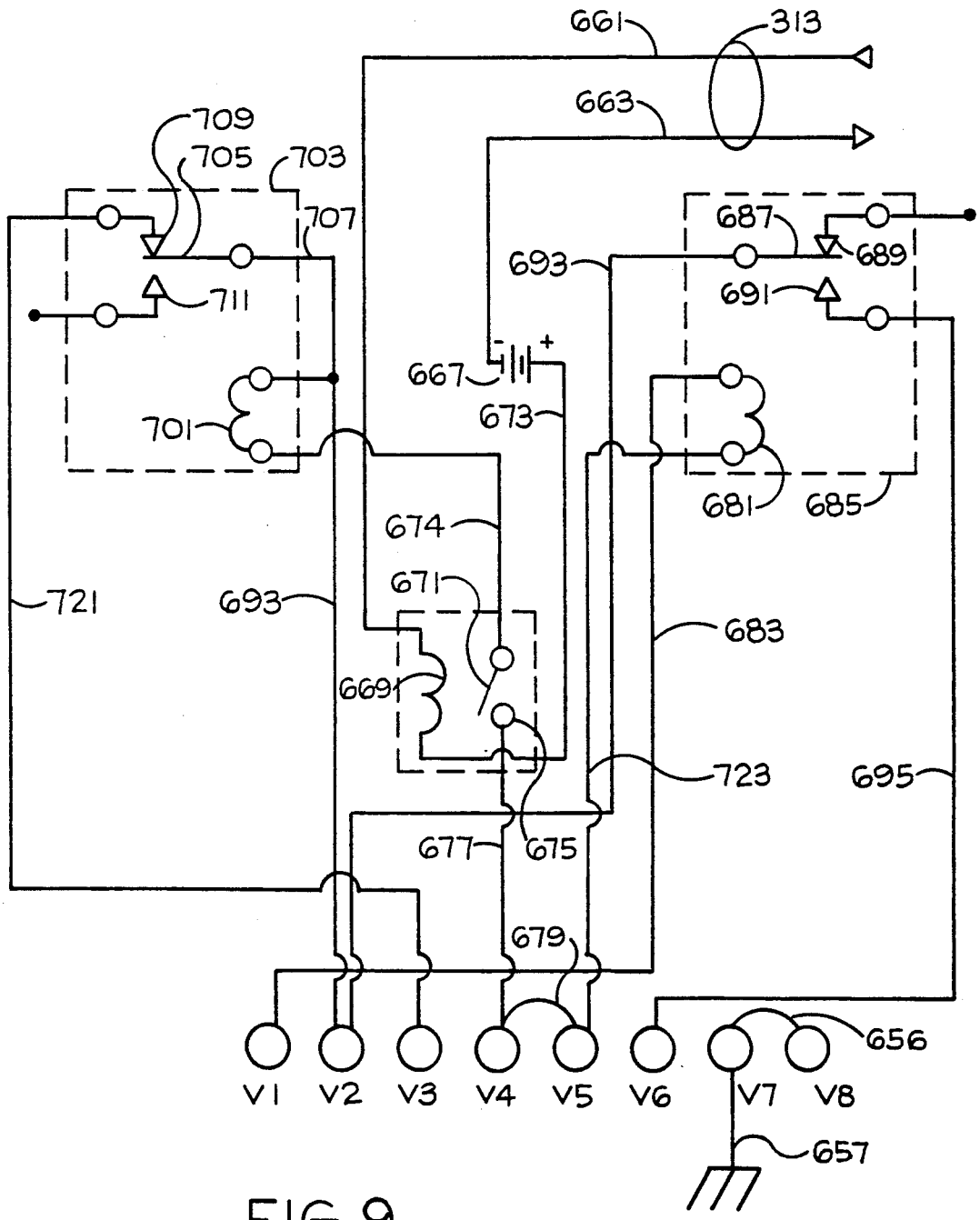
FIG. 9 is a schematic of the vacuum module of FIG. 8.

Referring now to FIGS. 8 and 9, the vacuum system will be described in detail. Terminals V1–V8 are connected to the external components as shown in FIG. 8, and to the internal components of the vacuum module 601 as shown in FIG. 9.

In FIG. 8, the electrical plug 303, has a hot prong terminal 303H, a neutral prong terminal 303N, and a safety ground prong terminal 303G. Member 603 is a manually controllable double pole switch; member 605 is a normally closed push button switch; and member 607 is an electrical time delay circuit which has a time delay of about 5 seconds. Time delay 607 is the same as time delay 405. The electric motors 107M and 109M of vacuum blowers 107 and 109 are illustrated. In FIG. 8, leads 621, 623, 625, 627, 629, 631, 633, and 635 are hot leads which are connected as shown. Leads 641, 643, 645, and 647 are neutral return leads which are connected as shown. Leads 651, 653, 655, and 657 are safety earth ground leads. Members 659 is a green light indicating full vacuum.

Referring to FIG. 9, leads 661 and 663 are connected to the float switch 307 which is normally open and closes upon rise of the liquid in the vacuum tank 27 to a given level. Lead 663 is connected to the minus side of a battery 667. The plus side of the battery 66 is connected by way of lead 673 to a coil 669 which also is connected to lead 661. Coil 669 controls a switch 671 Which is connected to lead 674 and is adapted to contact terminal 675 which is connected by lead 677 to terminal V4 which in turn is connected to terminal V5 by lead 679. When the coil 669 is de-energized, switch 671 is normally open. When the coil 669 is energized, switch 671 closes and completes a circuit to coil 701 by way of lead 674. Coil 681 forms part of a half vacuum relay 685 which includes a switch 687 adapted to contact terminals 689 and 691. Switch 687 is connected to terminal V2 by way of lead 693 and terminal 691 is connected to terminal V6 by way of lead 695. When coil 681 is de-energized, switch 687 normally contacts terminal 689, which has no electrical connection to the circuit. When the coil 681 is energized, switch 687 contacts terminal 691.

Coil 701 forms part of an overflow relay 703 which includes a switch 705 connected to coil 701 by lead 707 and terminals 709 and 711. Terminal 709 is connected to terminal V3 by way of lead 721 and terminal 711 has no electrical connection to the circuit.

The system of FIGS. 8 and 9 operates in the following manner, assuming that the float switch 307 is open. When switch 603 is closed, electrical current is applied by way of lead 621 to the switch 603 and from the switch 603 to terminal V2 by way of lead 623. From terminal V2, electrical current is applied to terminal V3 by way of lead 693, normally closed switch 705, terminal 709 and lead 721. From terminal V3, electrical current is applied to the vacuum blower motor 107M by way of lead 625.

From terminal V3, electrical current is applied by way of lead 627 to normally closed push button switch 605, and to the time delay 607 by way of lead 629. After a time delay of about 5 seconds, current is applied by way of lead 631 to terminal V1. From V1, current is applied by way of lead 683, to coil 681 and from coil 681 to terminal V5 by way of lead 723. Coil 681 is energized causing switch 687 to engage terminal 691, completing a circuit from V2 to terminal V6 by way of lead 693, switch 687, terminal 691 and lead 695. From terminal V6, current is applied by way of lead 633 to the vacuum blower motor 109M.

If only half vacuum is desired, switch 605 is opened, disconnecting terminal V6 from terminal V2.

If the float switch 307 closes upon a rise of liquid in tank 27, leads 661 and 663 are connected together and coil 669 is energized, closing switch 671. This causes coil 701 to be energized, which moves switch 705 away from terminal 709 into engagement with terminal 711 disconnecting terminal V3 from terminal V2, causing both vacuum blower motors 107M and 109M to shut down.

Lead 656 connects terminals V7 and V8 together.

In one embodiment, each of the vacuum blowers 107 and 109 were purchased from Ametek Lamb of Kent, Ohio as Model No. 115950 with a maximum air flow of 98.9 CFPM and a suction rating of 95 inches of water.

I claim:

1. A cleaning apparatus, comprising:

support means for supporting a spray means for receiving and spraying hot liquid onto a surface to be cleaned and a head means for withdrawing liquid and material from the surface by reduced pressure, container means for holding a supply of liquid, liquid pump means having a pump inlet and a pump outlet, heat exchanger means having a heat exchanger inlet and a heat exchanger outlet, means for coupling said pump inlet to said container, means for coupling said heat exchanger inlet to said pump outlet, a flexible high pressure liquid conduit coupled to said heat exchanger outlet and to said spray means, vacuum recovery tank means, flexible vacuum hose means coupled from said head means to said vacuum recovery tank means, first and second electrical vacuum blower means, each having an air inlet and an air outlet, said air inlet of said first blower means being coupled to said vacuum recovery tank and said air outlet of said first blower means being coupled to said air inlet of said second blower means, electrical power input means, electrical switch means coupled to said electrical power input means, first and second electrical blower terminal means, said first electrical blower terminal means being electrically coupled to said first blower means and said second electrical blower terminal means being electrically coupled to said second blower means, first electrical circuit means for applying electrical power to said first electrical blower terminal means upon actuation of said electrical switch means, electrical time delay means for producing an electrical outlet after a predetermined time period after an electrical input is applied to said electrical time delay means, and second electrical circuit means including said time delay means for applying electrical power from said first electrical blower terminal means to said second electrical blower terminal means by way of said electrical time delay means.

2. The cleaning apparatus of claim 1, comprising:

a flow control valve coupled between said spray means and said flexible high pressure liquid conduit, a liquid return conduit coupled to said flow control means and to said container means, said flow control valve being controllable to allow liquid in said high pressure liquid conduit to flow to said spray means or to said liquid return conduit.

* * * * *